US006325208B1

(12) United States Patent
Cheng

(10) Patent No.: US 6,325,208 B1
(45) Date of Patent: Dec. 4, 2001

(54) BASE OF GOLF BAG

(76) Inventor: Wen-Chien Cheng, P.O. Box 453, Taichung (TW)

( * ) Notice: Subject to any disclaimer, the term of this patent is extended or adjusted under 35 U.S.C. 154(b) by 0 days.

(21) Appl. No.: 09/691,146

(22) Filed: Oct. 19, 2000

(51) Int. Cl.[7] ..... A63B 55/00
(52) U.S. Cl. ..... 206/315.7; 248/96
(58) Field of Search ..... 206/315.7; 248/96

(56) References Cited

U.S. PATENT DOCUMENTS 5,219,074 * 6/1993 Mizumo et al. ..... 220/836 X
5,762,189 * 9/1999 Reimers ..... 206/315.7
5,799,786 * 9/1998 Beck et al. ..... 206/315.7
5,901,845 * 5/1999 Cheng ..... 206/315.7
6,010,101 * 1/2000 Stein et al. ..... 248/96
6,098,797 * 8/2000 Han ..... 206/315.7

* cited by examiner

*Primary Examiner*—Allan N. Shoap
*Assistant Examiner*—Tri M. Mai
(74) *Attorney, Agent, or Firm*—Harrison & Egbert

(57) ABSTRACT

A golf bag comprises a bag body, a support rod, a bracing rod, and a base. The support rod is pivotally fastened at the top end with the bag body. The bracing rod is pivotally fastened at the top end of the support rod. The base is fastened with the bottom end of the bag body and the bottom end of the bracing rod. The base is formed of a seat member and an action member pivoted to the seat member. The seat member is fastened in the top with the bottom end of the bag body and is provided in the bottom with an inclined plane. The action member is of a U-shaped construction and is provided in the crown portion with a connection portion which is connection with the bottom end of the bracing rod. The action member is pivoted at both arms thereof to the seat member.

1 Claim, 5 Drawing Sheets

BASE OF GOLF BAG

BACKGROUND OF THE INVENTION

1. Field of the Invention

The present invention relates generally to a golf bag, and more particularly to a base of the golf bag.

2. Description of Related Art

The conventional golf bag has a base which is formed of a seat plate and an action plate mounted pivotally on the seat plate. The process of mounting the action plate on the seat plate is rather time-consuming. In addition, it is impossible to replace a damage action plate.

BRIEF SUMMARY OF THE INVENTION

The primary objective of the present invention is to provide a golf bag with a base which is free from the deficiencies of the base of the conventional golf bag described above.

In keeping with the principle of the present invention, the foregoing objective of the present invention is attained by a golf bag base comprising a seat member and an action member. The seat member is provided with two pivoting holes, whereas the action member is provided with two pivoting blocks. The action member is pivotally fastened with the seat member such that the two pivoting blocks of the action member are received in the two pivoting holes of the seat member.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
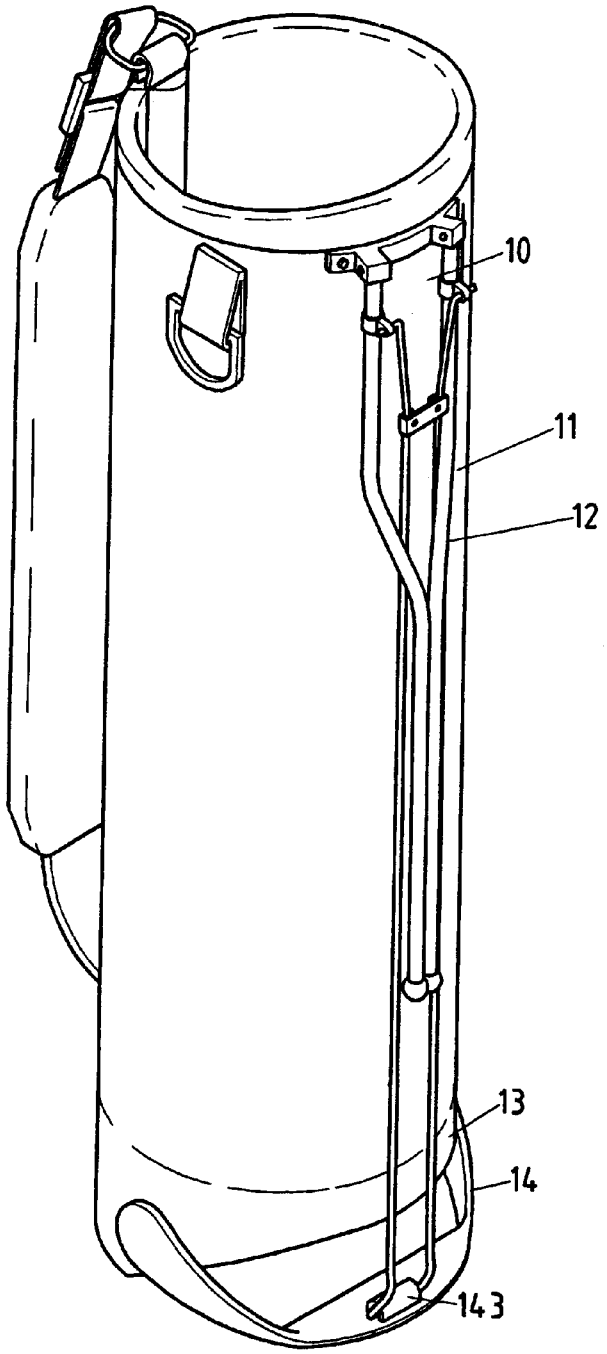
FIG. 1 shows a perspective view of the preferred embodiment of the present invention.
Figure 2:
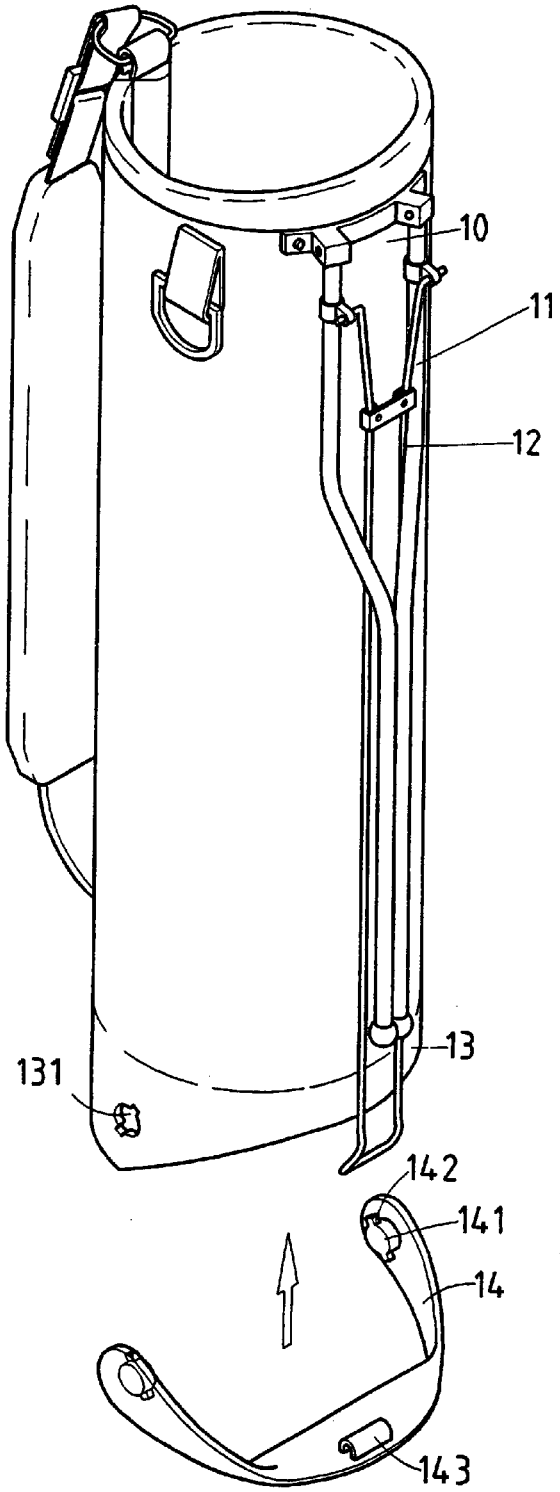
FIG. 2 shows an exploded view of the preferred embodiment of the present invention.
Figure 3:
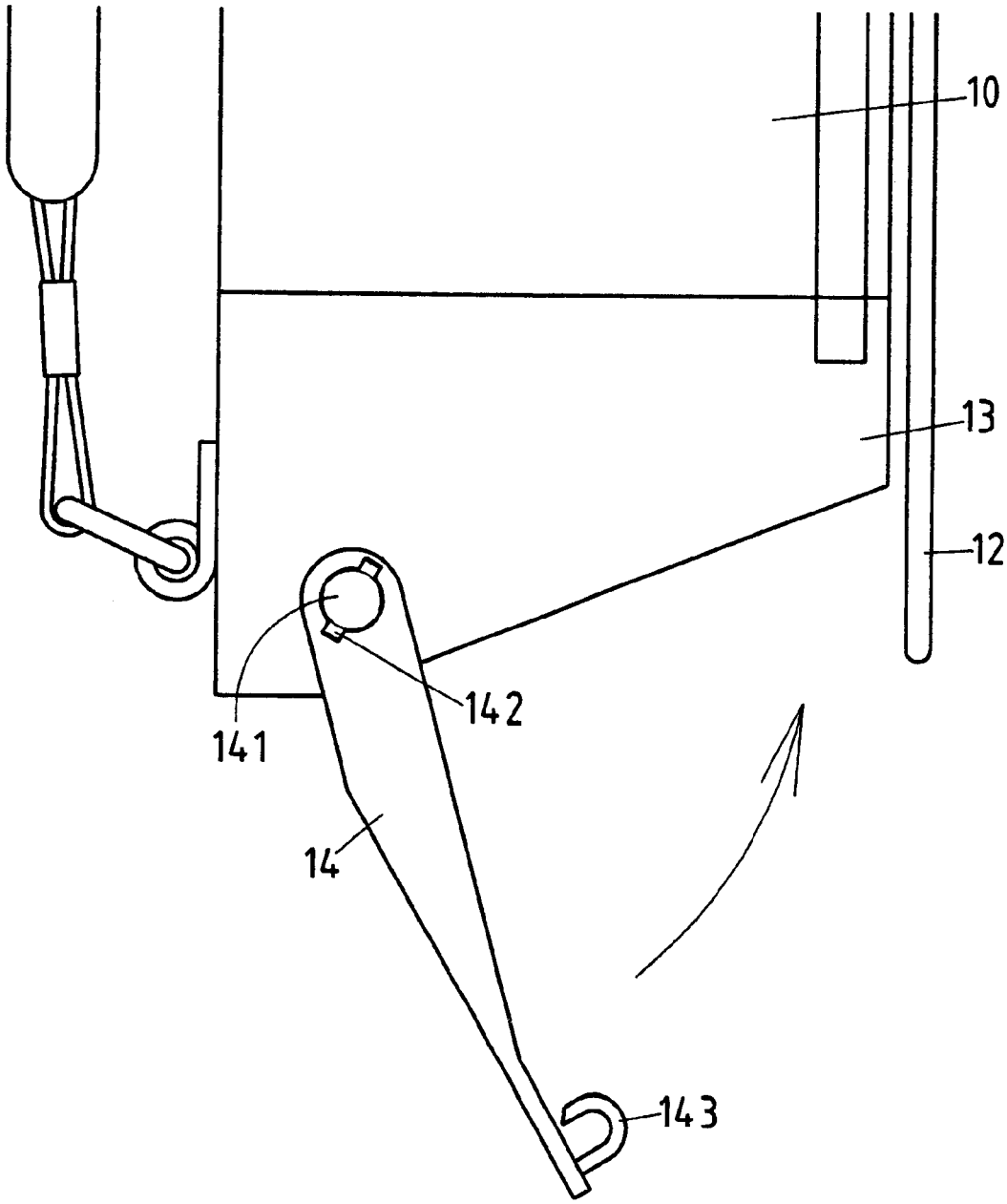
FIG. 3 shows a schematic view of the preferred embodiment of the present invention at work.
Figure 4:
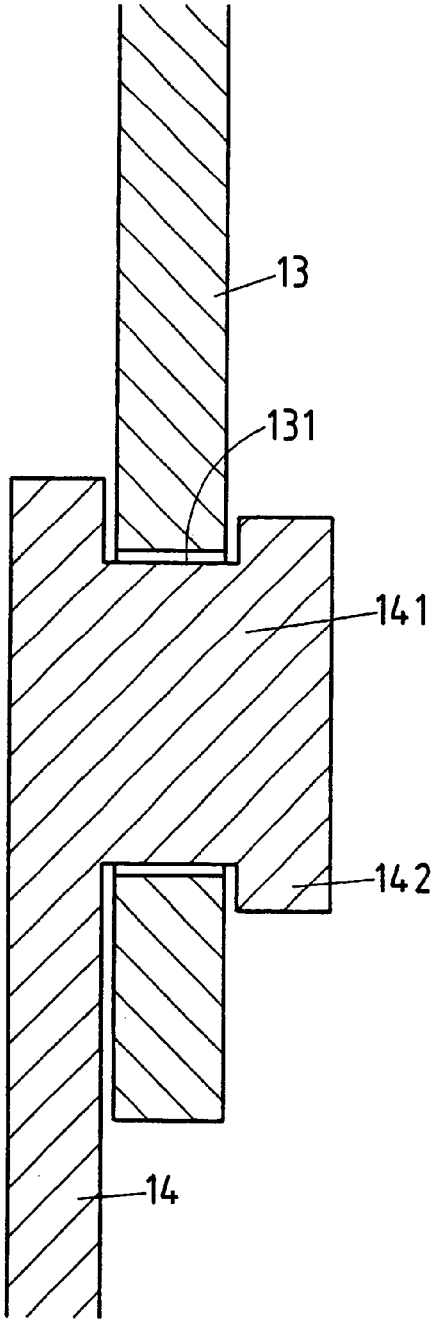
FIG. 4 shows a partial sectional view of the preferred embodiment of the present invention.
Figure 5:
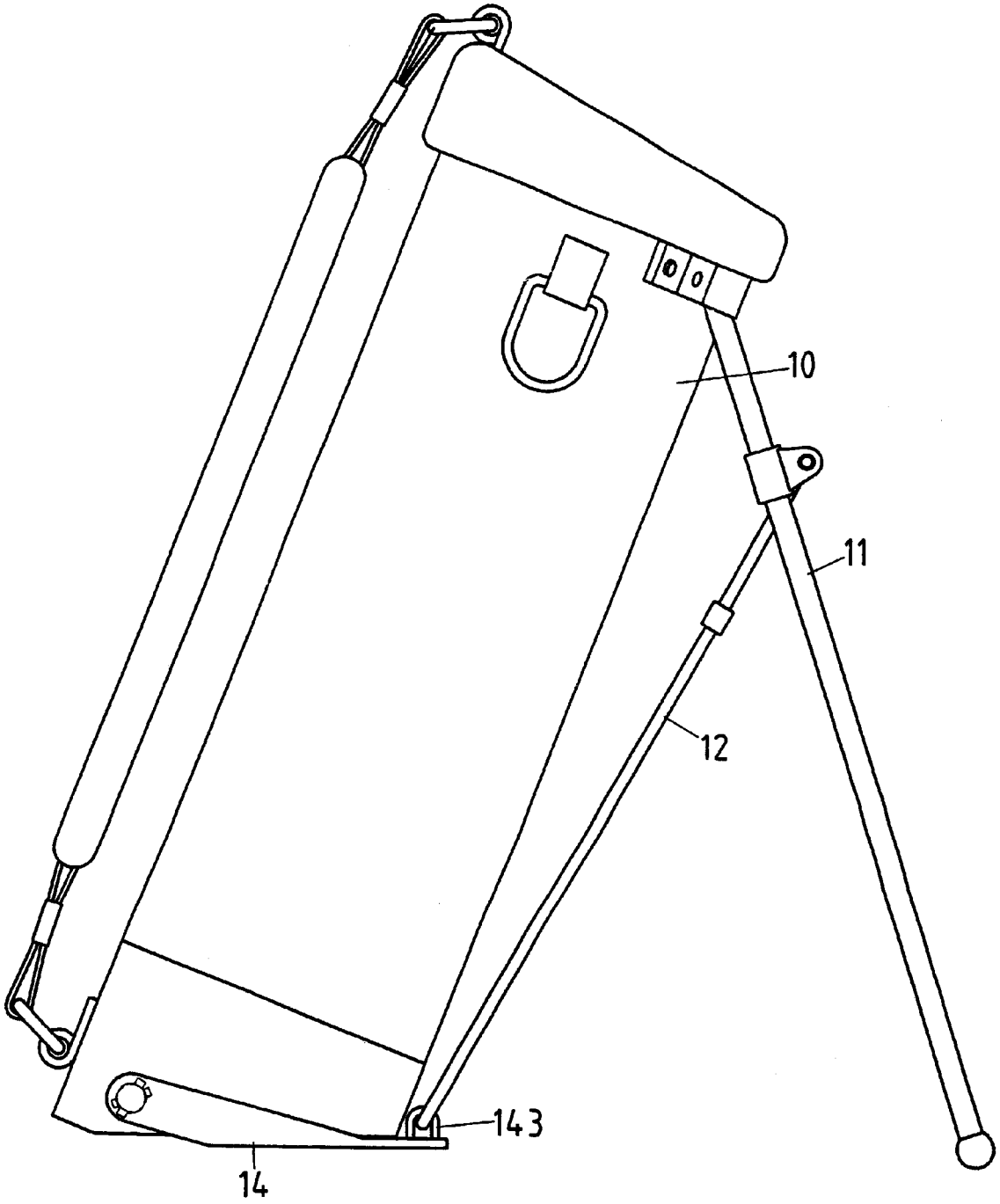
FIG. 5 shows a schematic view of the preferred embodiment of the present invention in use.

As shown in FIGS. 1–5, a golf bag of the preferred embodiment of the present invention comprises a bag body 10, a support rod 11, a bracing rod 12, and a base which is formed of a seat member 13 and an action member 14. The bottom of the bag body 10 is fastened with the seat member 13 of the base. The seat member 13 is provided with two pivoting holes 131 opposite in location to each other. The action member 14 is of a U-shaped construction and is provided in two arms thereof with a pivoting block 141 having two stop blocks 142 opposite to each other. The action member 14 is further provided in the crown portion thereof with a connection portion 143 by which the action member 14 is connected with the bottom end of the bracing rod 12. The action member 14 is pivotally fastened with the seat member 13 such that the pivoting blocks 141 of the action member 14 are received in the pivoting holes 131 of the seat member 13. It must be noted here that the bottom of the seat member 13 has an inclined plane. The bracing rod 12 is pivoted at the top end thereof with the support rod 11.

In light of the action member 14 being fastened pivotally with the seat member 13, the action member 14 can be swiveled such that the connection portion 143 of the action member 14 catches the U-shaped bottom end of the bracing rod 12.

The embodiment of the present invention described above is to be regarded in all respects as being merely illustrative and not restrictive. accordingly, the present invention may be embodied in other specific forms without deviating from the spirit thereof. The present invention is therefore to be limited only by the scope of the following appended claim.

I claim:

1. A golf bag comprising:

a bag body;

a support rod having a top end pivotally connected to said bag body;

a bracing rod having a top end pivotally fastened to said support rod; and a base fastened to a bottom end of said bag body and to a bottom end of said bracing rod, said base comprising:

a seat member fastened to said bottom end of said bag body, said seat member having a first hole and a second hole on opposite sides of said seat member from each other, each of said first and second holes having slots communicating with the respective holes and extending radially outwardly therefrom, said seat member having an inclined surface; and an action member of U-shaped construction, said action member having a crown portion with a connection portion connected to said bottom end of said bracing rod, said action member having two arms extending separately outwardly from said crown portion, each of said two arms having a pivoting block on an inner surface thereof, said pivoting block having first and second stop blocks extending radially outwardly therefrom on opposite sides of said pivoting block, said first and second stop blocks having a size suitable for passing through respective said opposing slots, said first and second stop blocks residing on an interior of said seat member, said two arms extending outwardly from an exterior surface of said seat member, the pivoting blocks being retained within respective said first and second holes of said seat member.

* * * * *